United States Patent [19]

Shikama et al.

[11] Patent Number: 4,516,054

[45] Date of Patent: May 7, 1985

[54] LAMP PROTECTION ARRANGEMENT

[75] Inventors: Takashi Shikama, Yokaichi; Tomoyuki Yamamoto, Omihachiman; Atsuo Yokota, Yokaichi, all of Japan

[73] Assignee: Murata Manufacturing Co., Ltd., Japan

[21] Appl. No.: 393,794

[22] Filed: Jun. 30, 1982

[30] Foreign Application Priority Data

Jul. 31, 1981 [JP] Japan ..... 56-115213[U]

[51] Int. Cl.[3] ..... H01J 7/44; H01J 17/34; H01J 19/78; H01J 29/96

[52] U.S. Cl. ..... 315/71; 315/309; 328/8; 323/369; 323/908; 338/219

[58] Field of Search ..... 315/71, 309, 70; 338/219, 220; 328/8, 11; 323/369, 908

[56] References Cited

U.S. PATENT DOCUMENTS 2,668,930 2/1954 Suits ..... 315/71 X
3,372,302 3/1968 Fasola ..... 315/71 X
3,930,183 12/1975 Harnden, Jr. ..... 315/71
3,975,658 8/1976 Emtage et al. ..... 315/71
4,366,416 12/1982 Yokoyama ..... 315/71

FOREIGN PATENT DOCUMENTS 2361792 6/1975 Fed. Rep. of Germany ..... 315/71

*Primary Examiner*—Saxfield Chatmon
*Attorney, Agent, or Firm*—Ostrolenk, Faber, Gerb & Soffen

[57] ABSTRACT

A light bulb protection arrangement including a lamp, a socket, and a junction socket having a base portion and a socket portion so as to attach the light bulb to the socket. The junction socket includes a connecting terminal, a first terminal to be connected to the central electrode of the socket, a second terminal to be connected to the central electrode of the light bulb, and a negative temperature coefficient thermistor connected between the first terminal and the second terminal.

15 Claims, 13 Drawing Figures

LAMP PROTECTION ARRANGEMENT

BACKGROUND OF THE INVENTION

The present invention relates to an incandescent light bulb (hereinbelow referred to as "lamp") and more particularly, to a light protection arrangement for protecting the light against rush current when the light is first turned on.

When a light is first turned on, a rush of current greater than its rated current flows through the filament of the light additionally, since lights generally exhibit resistance value, (approximately 10 times lower) when they are in use and when they are not in use, the rush of current when the light is first turned on is extraordinarily high with the result that the filament of the light sharply rises in temperature, thereby undesirably shortening the life of the light due to thermal fatigue of the filament.

Accordingly, it has been conventionally proposed that a negative temperature coefficient (NTC) thermistor 3 be connected in series between a power source 1 and a light 2 as shown in FIG. 1 so as to lengthen the life of the light 2. Specifically, since when a switch 4 is initially closed the light 2 has a small resistance value (approximately 10% of the rated value), a large rush of current would flow into the filament of the light 2, if the NTC thermistor 3 is not provided. However, when the NTC thermistor 3 is provided as shown in FIG. 1, the rush of current when the light is first turned on is restricted to a relatively small value, and the light 2 reaches substantially steady brightness after a predetermined time period as the NTC thermistor 3 is lowered in resistance due to its self-heating. When the rush of current is prevented from flowing into the light 2 as described above, the filament does not rise sharply in temperature, so that the filament is less subjected to thermal fatigue, whereby the life of the light 2 can be desirably lengthened.

While the NTC thermistor may be used in a circuit where power is supplied exclusively to the light, it cannot be used in a circuit where other electrical parts are supplied power together with the light because the NTC thermistor may have a derogatory effect on such electrical parts. For this reason the above-described NTC thermistor has not in practice been applied to the light in spite of its known usefulness.

Accordingly, an essential object of the present invention is to provide an improved light protection arrangement which does not require any additional wiring or special works so as to lengthen the life of a light and prevent damage to the light due to abnormal current, with substantial elimination of the disadvantages inherent in conventional light protection arrangements of this kind.

Another important object of the present invention is to provide an improved light protection arrangement of the above-described type which is simple in structure, highly reliable in actual use and suitable for mass production at low cost.

BRIEF DESCRIPTION OF THE INVENTION

In accomplishing these and other objects according to one preferred embodiment of the present invention, there is provided an improved light protection arrangement including a junction socket comprising a base portion to be attached to a socket, and a socket portion to which a light is attached. In the base portion, there are provided a first spring terminal to be connected to the central electrode of the socket, a second spring terminal to be connected to the central electrode of the light, and a negative temperature coefficient (NTC) thermistor to be connected to the first and second spring terminals.

In accordance with the present invention, the life of the light can be lengthened remarkably by the use of the NTC thermistor accommodated in the junction socket without the need for changing the wiring or the profiles of the light and the socket.

BRIEF DESCRIPTION OF THE DRAWINGS

These and other objects and features of the present invention will become apparent from the following description taken in conjunction with the preferred embodiment thereof with reference to the accompanying drawings, in which.

DETAILED DESCRIPTION OF THE PRESENT INVENTION

Figure 1:
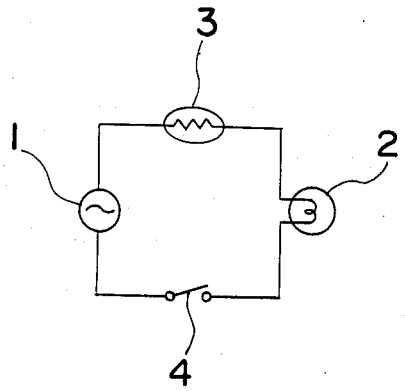
FIG. 1 is an electrical circuit diagram of a general light protection circuit.
Figure 2:
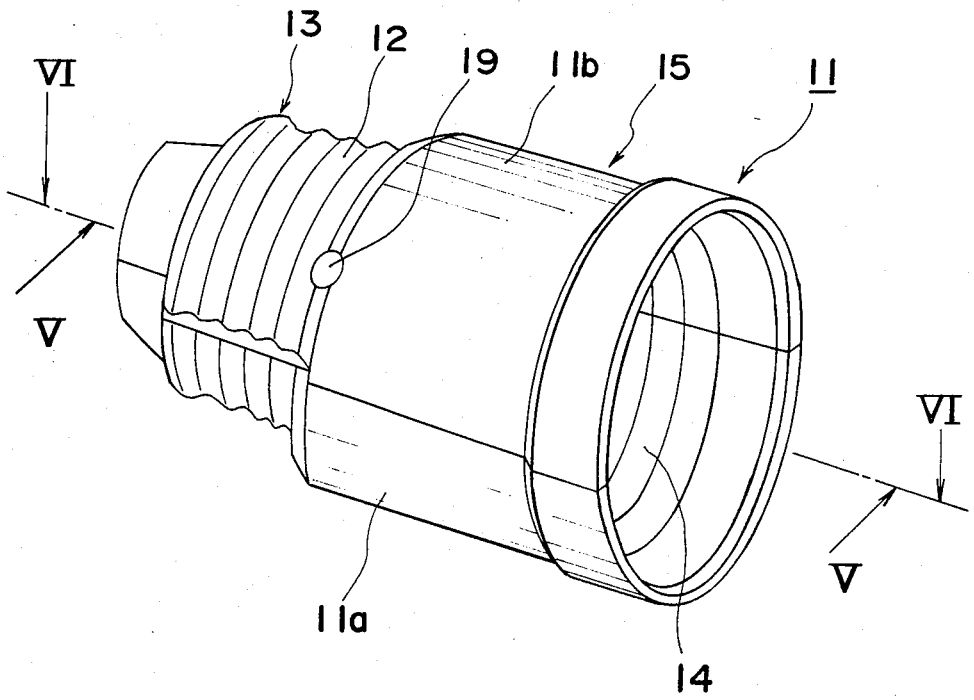
FIG. 2 is a perspective view of a junction socket employed in a light protection arrangement according to the present invention.

Before the description of the present invention proceeds, it is to be noted that like parts are designated by like reference numerals throughout several views of the accompanying drawings.

Referring now to the drawings, there is shown in FIGS. 2 to 6, a junction socket 11 employed in a light protection arrangement according to the present invention.

The junction socket 11 is formed in a two-piece construction and comprises a casing 11*a* and a casing 11*b* split in an axial direction thereof. The casings 11*a* and 11*b* are made of heat resistant synthetic resin and includes a base portion 13 having an external thread 12 and a socket portion 15 having an internal thread 14 in such a manner that the base portion 13 may be screwed into a standard lamp socket and the base of a light bulb may be screwed into the socket portion 15. The casing 11*a* accommodates therein various terminals and a negative temperature coefficient (NTC) thermistor 16 to be described below and the casing 11*b* is mounted on the casing 11*a* so as to cover the above-described electrical parts.

Figure 3:
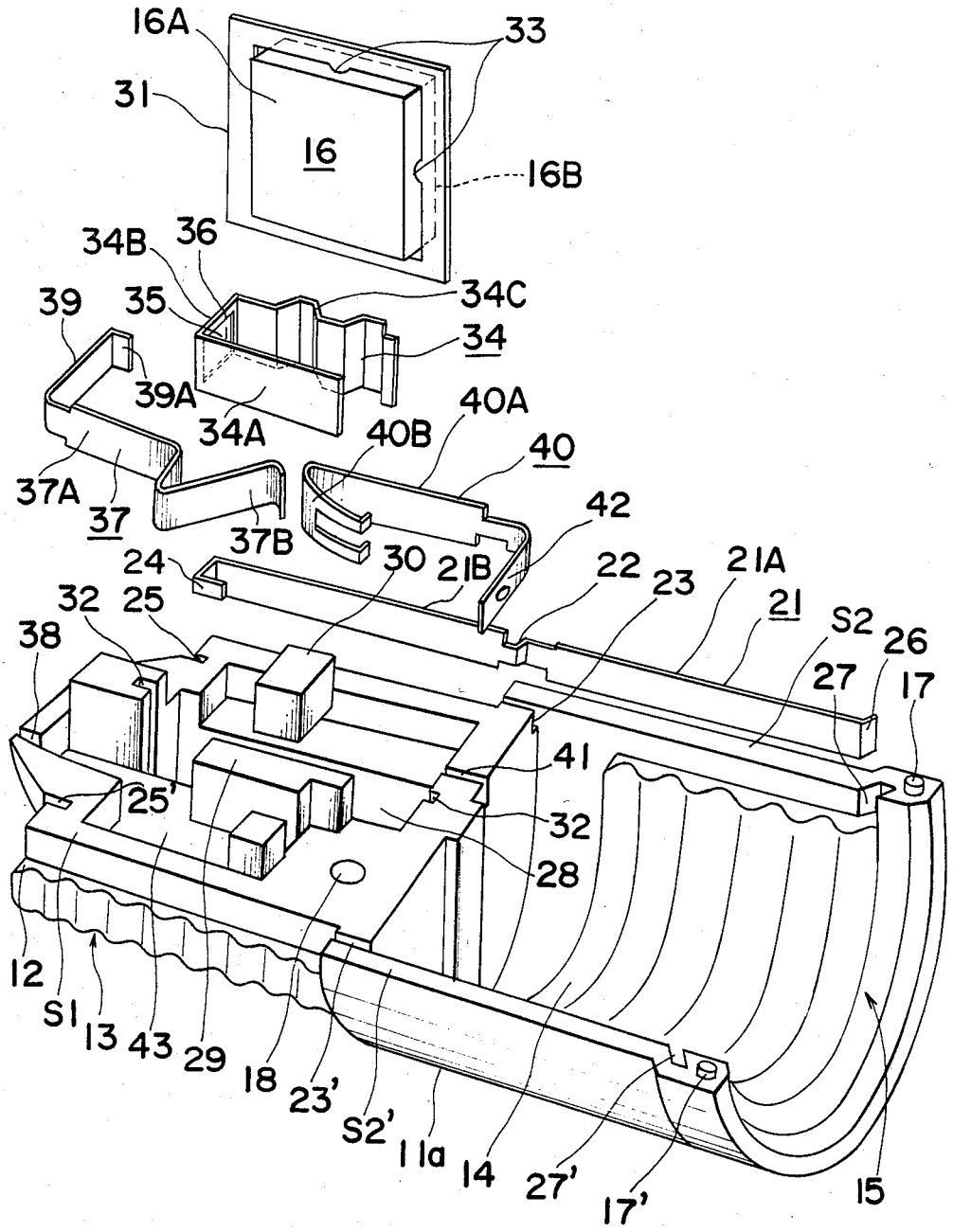
FIG. 3 is an exploded view showing, on an enlarged scale, a main part of the junction socket of FIG. 2.
Figure 4:
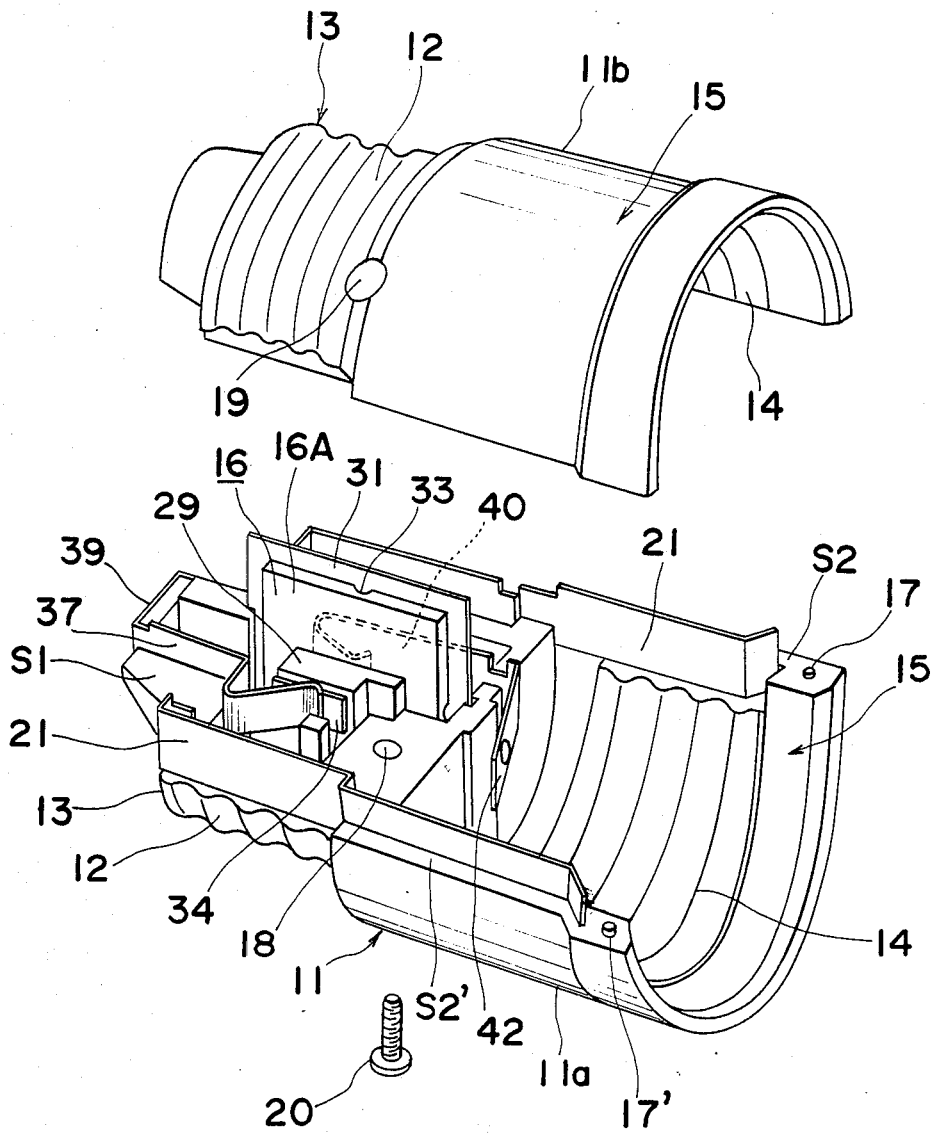
FIG. 4 is an exploded view showing the whole structure of the junction socket of FIG. 2.
Figure 5:
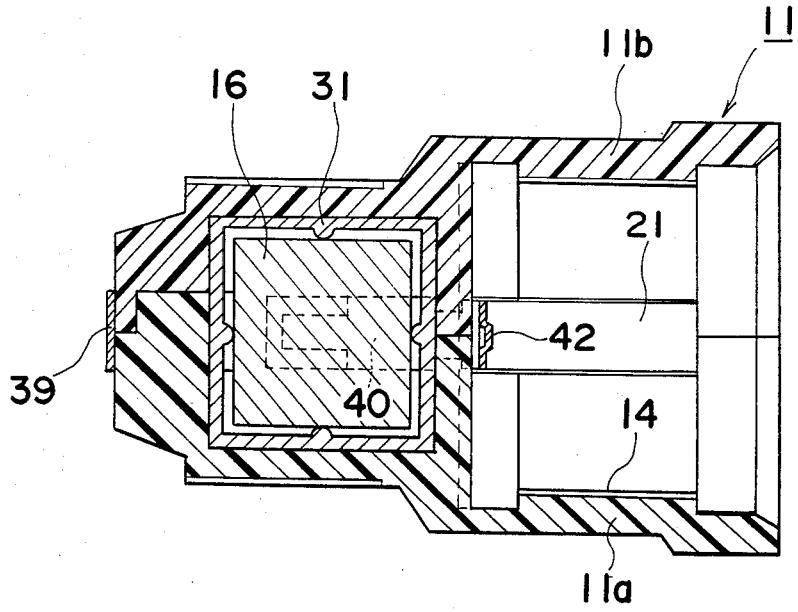
FIG. 5 is a cross-sectional view taken along the line V—V in FIG. 2.

As shown in FIGS. 3 and 4, the casing 11*a* has a flat contact surface which contacts the casing 11*b*, the flat contact surface comprising a substantially rectangular surface S1 at the base portion 13 and a pair of opposite elongated surfaces S2 and S2′ at the socket portion 15. The casing 11*a* has cylindrical projections 17 and 17′ provided, adjacent to one axial end of the socket portion 15 remote from the base portion 13, on the opposite elongated surfaces S2 and S2′, respectively. It is so arranged that the casing 11*a* is positioned with respect to the casing 11*b* by fitting the projections 17 and 17′ into corresponding small apertures (not shown) formed on a mating flat contact surface of the casing 11*b* when the casing 11*a* is coupled with the casing 11*b*. The casings 11*a* and 11*b* have through-holes 18 and 19, respectively formed therein at 19 locations which are aligned with each other and located adjacent to a boundary of the base portion 13 and socket portion 15. The casing 11*a* is secured to the casing 11*b* by inserting a machine screw 20 into the through-holes 18 and 19 and then tightening it. Although it be convenient that the machine screw 20 is a self-tapping machine screw, the casing 11*a* may be secured to the casing 11*b* by using a machine screw and a nut.

As best shown in FIG. 3, the elongated surface S2 has a slot 23 formed at one end thereof adjacent to the base portion 13 and a positioning slot 27 formed adjacent to the projection 17, while the elongated surface S2′ is provided with a slot 23′ and a positioning slot 27′ in the same manner. The surface S1 is provided with a recess 43 so that the peripheral edge portions may be brought into contact with the casing 11*b* and the recess 43 has a rectangular groove 28 formed approximately at a central portion thereof.

Moreover, the surface S1 has a slot 38, a positioning slot 44 (FIG. 6) and opposite positioning slots 25 and 25′ formed at one end therof remote from the socket portion 15 and has a slot 41 provided at the other end adjacent to the socket portion 15. Rectangular protrusions 29 and 30 are formed on the recess 43 at opposite sides of the groove 28. The recess 28 has slots 32 formed at opposite ends thereof.

Connecting terminals 21, the NTC thermistor 16 held by a support plate 31, a substantially U-shaped member 34, a spring terminal 37 and a spring terminal 40 are accommodated in the casing 11*a* and will be described with reference to FIG. 3, hereinbelow.

The connecting terminals 21 are each made by bending an elongated metal plate like a band plate and comprises a straight portion 21A, a straight portion 21B and a central bent portion 22 connecting the straight portions 21A and 21B. The bent portion 22 is bent at right angles with respect to the straight portion 21A and the straight portion 21B extends at right angles respect to the bent portion 22 and parallel to the straight portion 21A. The straight portion 21A is provided with a bent end portion 26 extending at an obtuse angle therewith in a direction opposite to that of the bent portion 22. Meanwhile, the straight portion 21B is formed with a U-shaped end portion 24 at one side of the straight portion 21B remote from the bent portion 22. It should be noted that the slots 23 and 23′, positioning slots 25 and 25′, and positioning slots 27 and 27′ are formed on the casing 11*b* so to receive the terminals 21.

Figure 6:
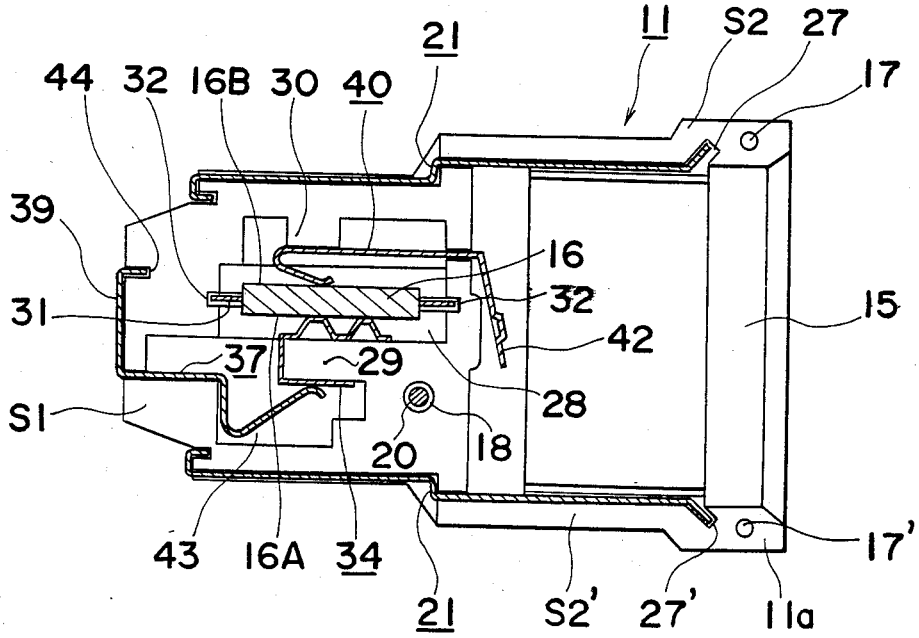
FIG. 6 is a cross-sectional view taken along the line VI—VI in FIG. 2.

The NTC thermistor 16 is rectangular in form and is held at its periphery by a rectangular support plate 31. The support plate 31 is made of heat resistant inorganic materials such as mica or heat resistant organic materials and is formed into a rectangular frame. Each side of the support plate 31 is provided with a semicircular projection portion 33 extending inwardly from a central portion thereof so that the NTC thermistor 16 with considerable variations in dimensions may be securely held in the support frame 31. As best shown in FIG. 6, the NTC thermistor 16 has electrodes 16A and 16B on opposite sides thereof.

The substantially U-shaped member 34 is made of a metal plate having a low electric conductivity such as stainless steel, and comprises a flat portion 34A (FIG. 3), a central portion 34B and a corrugated portion 34C. The flat portion 34A and corrugated portion 34C extend at right angles with respect to the central portion 34B in the same direction with respect to the central portion 34B. The central portion 34B is formed with a through-opening 35 and has peripheral edge portions 36 provided at is periphery. These edge portions function as a fuse against abnormally large current.

The spring terminal 37 is made by bending an elongated metal plate and comprises a connecting portion 39, a central portion 37A and a V-shaped portion 37B. The connecting portion 39 having a bent end portion 39A extends approximately at right angles with the central portion 37A and the V-shaped portion 37B extends in a direction opposite to that of the connecting portion 39.

Meanwhile, the spring terminal 40 is also made by bending an elongated metal plate and comprises a connecting portion 42, a central portion 40A and a bent portion 40B. The connecting portion 42 extends approximately at right angles with respect to the central portion 40A, while the bent portion 40B formed at the same side of the central portion 40A as the connecting portion 42 extends at an acute angle with respect to the central portion 40A.

Figure 13:
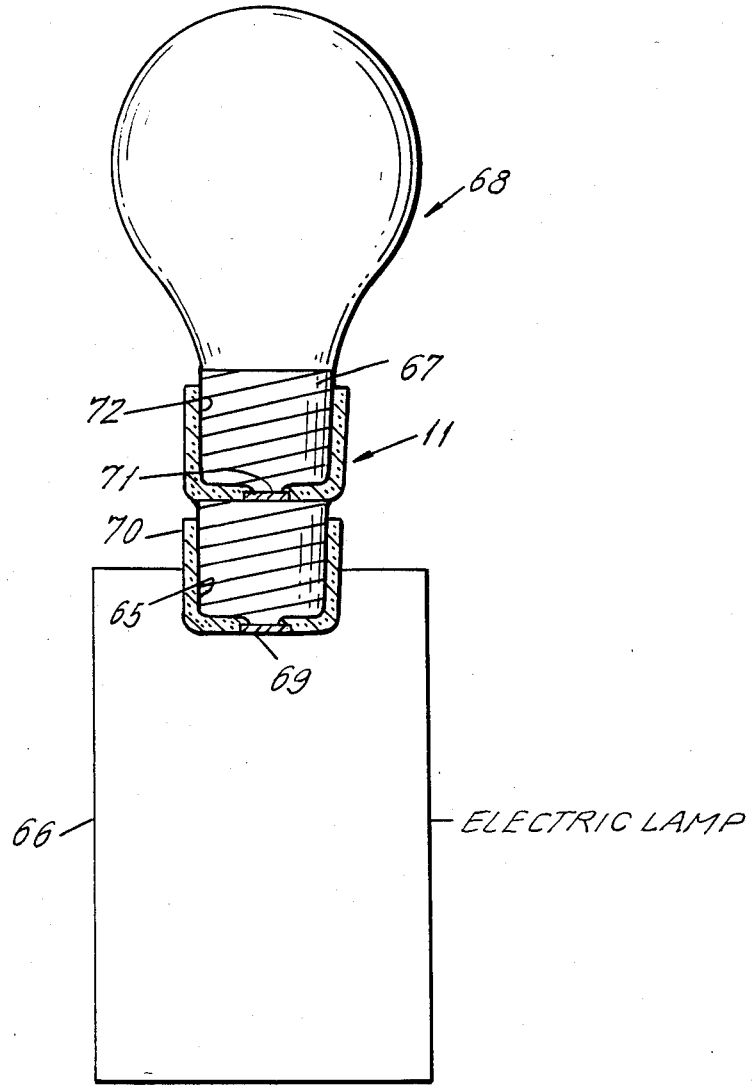
FIG. 13 is a schematic drawing illustrating the manner in which the junction socket of FIGS. 2–12 acts as an interface between the based socket of an electric lamp and the base of a light bulb.

The structures of the casings 11*a* and 11*b*, various terminals and the NTC thermistor 16, etc. have been described. their assembly and functions will now be described with reference to FIGS. 2 to 6 and 13. FIG. 13 schematically illustrates the connection between the junction socket 11, the socket 65 of an electric lamp 66 and the base 67 of a light bulb 68.

It is to be noted that the lamp socket 65 and has a central terminal 69 and a peripheral terminal 70. Similarly, the light bulb 68 has a central terminal 71 and a peripheral terminal 72. Two connecting terminals 21 are mounted on the casing 11*a*. One connecting terminal 21 is mounted on the casing 11*a* by fitting the bent portion 22 into the slot 23 so that the straight portion 21B and straight portion 21A may be positioned outside the base portion 13 and inside the socket portion 15, respectively. Then, the U-shaped end portion 24 of the straight portion 21B is fitted into the positioning slot 25, while the bent end portion 26 of the straight portion 21A is fitted into the positioning slot 27. Likewise, the other connecting terminal 21 is mounted on the casing 11*a* through the slot 23′, and positioning slots 25′ and 27′. Thus, two connecting terminals 21 are mounted on the casing 11*a* so that the straight portions 21A and 21B may be connected to the peripheral terminals 72, 65 of the light 68 and the socket 65, respectively.

It should be noted here that, although, in this embodiment, the connecting terminal 21 comprises the straight portions 21A and 21B, the straight portions 21A and 21B may be formed into a corrugated profile in compliance with pitches of threads of the light 68 and the socket, respectively or may be formed with projections in compliance with pitches of threads of the light 68 and the socket, respectively.

When the support plate 31 holding the NTC thermistor 16 therein is inserted into the recess 28, the support plate 31 is fitted into the slots 32 so that the NTC thermistor 16 may be held in position.

Meanwhile, the substantially U-shaped member 34 is provided so as to be fitted around the rectangular protrusion 29 so that the corrugated portion 34C may be brought into contact with the electrode 16A of the NTC thermistor 16. If a high-powered load such as an electric iron, an electric cleaner, etc. was inadvertently connected to the NTC thermistor 16, the NTC thermistor 16 would be placed in an abnormal state. In order to prevent such a phenomenon, it is so arranged that the peripheral edge portions 36 are caused to fuse when an overcurrent, for example, 3A flows into the member 34, whereby the NTC thermistor 16 is protected against overcurrents.

The spring terminal 37 is provided on one end of the base portion 13 remote from the socket portion 15 and is positioned by fitting the central portion 37A and bent end portion 39A into the slot 38 and positioning slot 44, respectively, as shown in FIGS. 4 and 6, so that the connecting portion 39 may be disposed outside the base portion 13, whereby the connecting portion 39 acts as a terminal for the central terminal 69 of the lamp socket 65 (FIG. 13) and the V-shaped portion 37B is brought into elastic contact with the flat portion 34A of the member 34.

The spring terminal 40 is provided between the protrusion 30 and the NTC thermistor 16, with the central portion 40A being fitted into the slot 41 formed on the surface S1, whereby the bent portion 40B is brought into elastic contact with the electrode 16B of the NTC thermistor 16 as shown in FIG. 6 and the connecting portion 42 projecting into the socket portion 15 acts as a terminal for the central terminal 71 of the light 68 (FIG. 13).

Meanwhile, although the casing of two-piece construction for the junction socket 11 has been described so far, it may be of one-piece construction. Furthermore, although it is desirable that the NTC thermistor 16 is formed into a rectangular shape as described above, it may be of other shapes such as a circle, etc.

It should be noted that the spring terminal 40 is made of a material having a large thermal resistance such as stainless steel as is the member 34 so as to prevent heat produced by the NTC thermistor 16 from being transmitted into the socket portion 15.

When the connecting terminals 21, NTC thermistor 16, and spring terminals 37 and 40 have been mounted on the casing 11*a*, the casing 11*b* is placed on the casing 11*a* and then, the casing 11*b* is secured to the casing 11*a* by the use of the machine screw 20.

Accordingly, when the light is attached to the socket through the junction socket 11, the straight portions 21A and 21B of each of the two connecting terminals 21 are brought into contact with the peripheral electrodes of the light and socket, respectively and the central electrodes of the socket and lamp are connected to each other through the spring terminal 37, member 34, NTC thermistor 16, and spring terminal 40, so that the NTC thermistor 16 restricts the rush of current when the light is initially turned on to a small value and causes a remarkably gradual rise of the temperature of the filament so as to lessen the thermal fatigue of the filament.

Moreover, even if overcurrent flows into the junction socket 11, the peripheral edge portions 36 of the member 34 function as a fuse so as to protect the NTC thermistor 16 against the overcurrent. When the peripheral edge portions 36 have been fused, the junction socket 11 can be reused only by replacing the fused member 34 with a new member 34.

Figure 7:
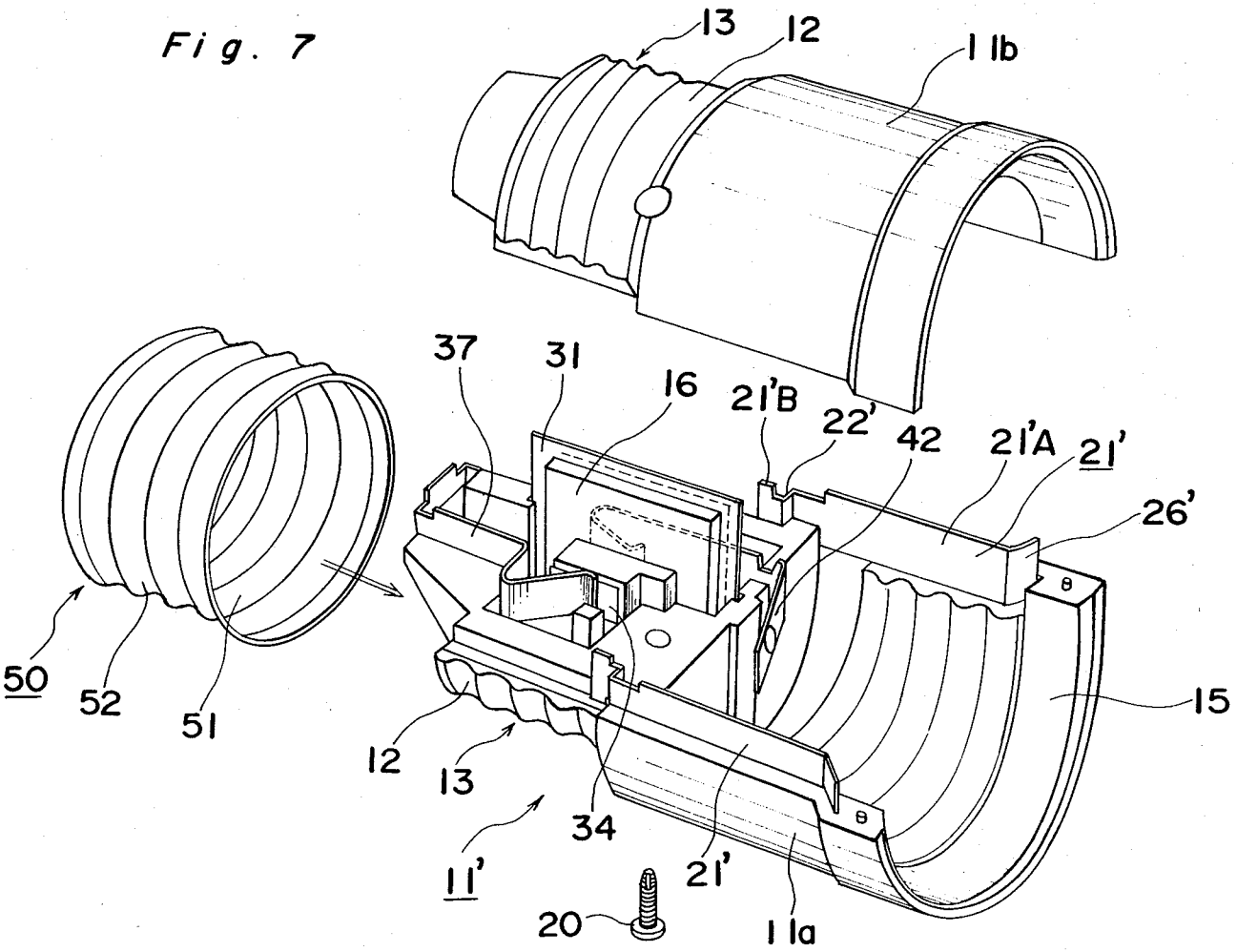
FIG. 7 is a view similar to FIG. 4, particularly showing a modification thereof.
Figure 8:
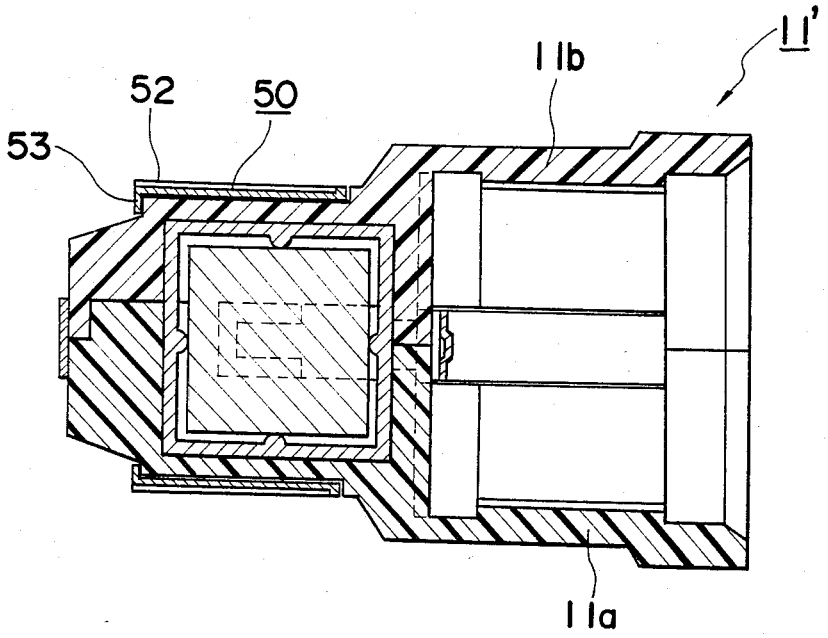
FIG. 8 is a view similar to FIG. 5, showing a cross section of the junction socket of FIG. 7.
Figure 9:
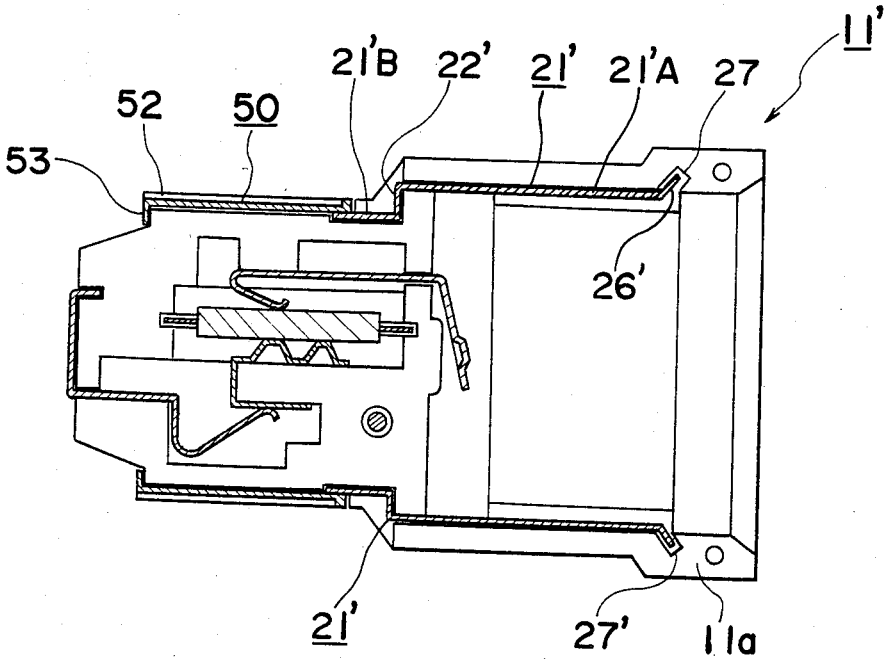
FIG. 9 is a view similar to FIG. 6, showing another cross section of the junction socket of FIG. 7.
Figure 10:
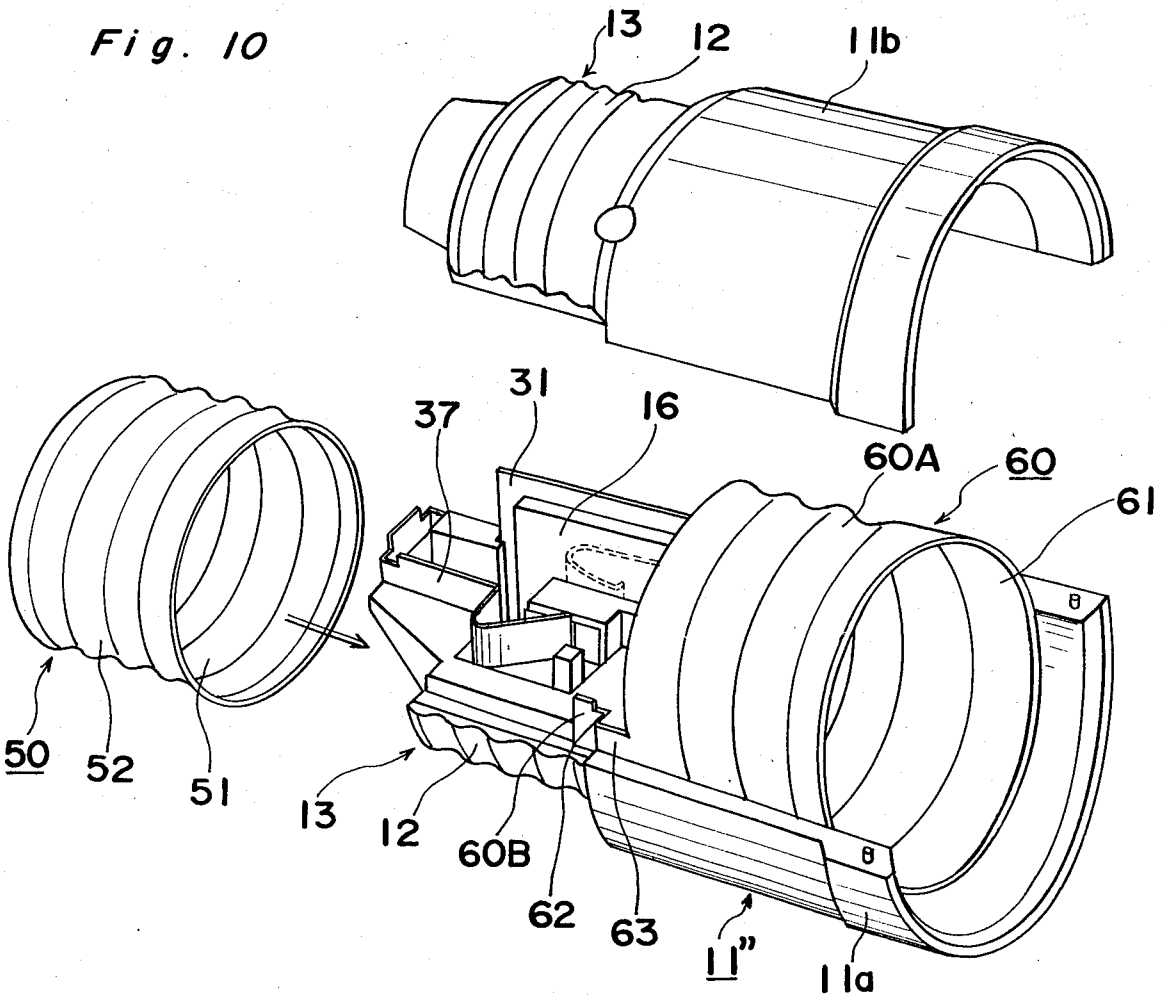
FIG. 10 is a view similar to FIG. 4, particularly showing a further modification thereof.
Figure 11:
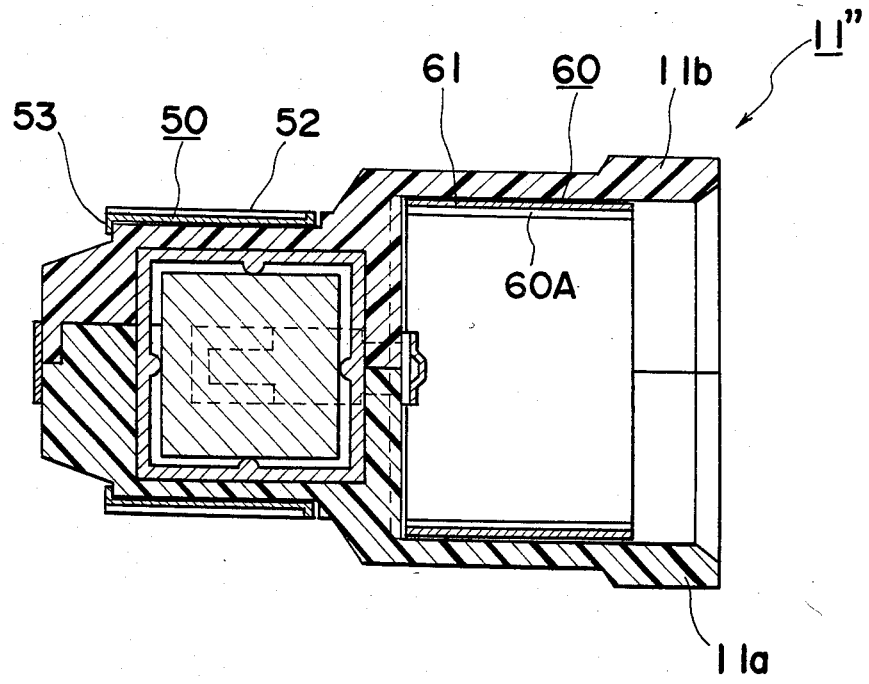
FIG. 11 is a view similar to FIG. 5, showing a cross section of the junction socket of FIG. 10.
Figure 12:
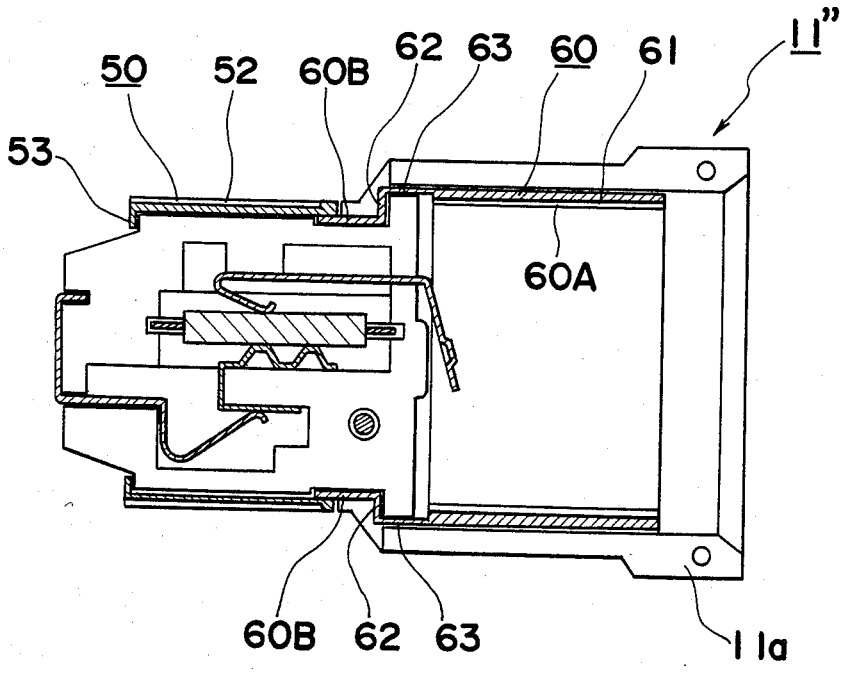
FIG. 12 is a view similar to FIG. 6, showing another cross section of the junction socket of FIG. 10.

Meanwhile, in order to connect more positively the straight portions 21A and 21B of the connecting terminal 21 to the peripheral electrodes of the lamp and the socket, respectively, the straight portion 21B can be replaced by a cylindrical cap 50 formed with an internal thread 51 and an external thread 52 as shown in FIGS. 7 to 9 or that, further, the straight portions 21A and 21B may be replaced by a cylindrical cap 60 formed with an internal thread 61 and the cylindrical cap 60, respectively as shown in FIGS. 10 to 12.

Referring to FIGS. 7 to 9, a junction socket 11′ according to a first modification of the junction socket 11 includes connecting terminals 21′ and the cap 50. The connecting terminal 21′ comprises a straight portion 21′A having a bent end portion 26′, a straight portion 21′B and a central bent portion 22′. In comparison with the connecting terminal 21, the straight portion 21′B is obtained by shortening, in length, the straight portion 21B to a large extent, with the straight portion 21′A and bent portion 22′ exactly corresponding to the straight portion 21A and bent portion 22. The cap 50 has a narrow end portion 53 extending, at one end thereof, over a slight distance inwardly and in a radial direction of the cap 50. After the casing 11*a* accommodating the connecting terminals 21′ etc. therein is secured to the casing 11*b* by the use of the machine screw 20, the base portion 13 is screwed into the cap 50 until the end portion 53 of the cap 50 is brought into contact with the shoulder of the base portion 13 so that the cap 50 thus attached to the base portion 13 may be screwed into the socket. It is so arranged that, when the cap 50 has been attached to the base portion 13, with the end portion 53 being in contact with the shoulder of the base portion 13, one end of the cap 50 remote from the end portion 53 is fitted around the straight portion 21′B of the connecting terminal 21′ so that the cap 50 may be electrically connected to the connecting terminal 21′. Since the external thread 52 formed on the overall outer circumference of the cap 50 is far larger, in the contact surface with the socket, than the straight portion 21B having a small width, the cap 50 attached to the base portion 13 is more positively connected to the peripheral electrode of the socket than the straight portion 21B is, so that the lamp is electrically connected to the socket more positively through the junction socket 11′ than through the junction socket 11. It should be noted that the positioning slots 25 and 25′ of the junction socket 11 are not required in the junction socket 11′. Since other arrangements of the junction socket 11′ are the same as those of the junction socket 11, the description thereof is abbreviated here for brevity.

Referring now to FIGS. 10 to 12, a junction socket 11″ according to a second modification of the junction socket 11 includes the cylindrical cap 50 and the cylindrical cap 60 formed with the internal thread 61. The cap 60 comprises a cylindrical portion 60A formed with the internal thread 61, two straight portions 63, two bent portions 62 and two straight portions 60B so that the straight portions 63 may be fitted into the slots 23 and 23' of the casing 11*a*. The bent portion 62 and straight portion 60B correspond to the bent portion 22' and straight portion 21'B of the junction socket 11'. After the cap 60 has been mounted on the casing 11*a* with the straight portions 63 being fitted into the slots 23 and 23', the cap 11*b* is secured to the casing 11*a* by the use of the machine screw 20 and then, the base portion 13 is screwed into the cap 50 until the end portion 53 of the cap 50 is brought into contact with the shoulder of the base portion 13 as described earlier. It is to be noted that when the base portion 13 has been fully screwed into the cap 50, one end of the cap 50 remote from the end portion 53 is fitted around the straight portions 60B so that the cap 50 may be electrically connected to the cap 60. It should be noted here that the internal thread 14, positioning slots 25 and 25' and positioning slots 27 and 27' of the junction socket 11 are not required in the junction socket 11''. Since the internal thread 61 formed on the overall inner circumference of the cap 60 is far larger, in the contact surface with the base of the lamp, than the straight portion 21'A having a small width, the lamp is electrically connected to the socket more positively through the junction socket 11'' than through the junction socket 11'. Since other arrangements of the junction socket 11'' are the same as those of the junction socket 11, the description thereof is abbreviated for brevity.

As is clear from the foregoing description, in a lamp protection arrangement according to the present invention, a first spring terminal to be connected to the central electrode of a socket, a second spring terminal to be connected to the central electrode of a lamp, and a negative temperature coefficient (NTC) thermistor connected between the first spring terminal and the second spring terminal are provided in the base portion of a junction socket for attaching the light to the socket.

Accordingly, in accordance with the present invention, the NTC thermistor can be connected in series to the power source without the need for changing the wiring or the profiles of the light and the socket, whereby the life of the light can be lengthened remarkably by the use of the NTC thermistor accommodated in the junction socket.

Meanwhile, in the case where the first spring terminal is provided with a fuse portion, the NTC thermistor can be protected against overcurrent, thus improving the durability of the thermistor to a large extent.

Although the present invention has been fully described by way of example with reference to the accompanying drawings, it is to be noted that various changes and modifications will be apparent to those skilled in the art. Therefore, unless otherwise such changes and modifications depart from the scope of the present invention, they should be construed as included therein.

What is claimed is:

1. A light bulb protection arrangement including a light bulb having a central terminal and a peripheral terminal, a socket having a central terminal and a peripheral terminal, and a junction socket, said junction socket comprising:

a case provided with a base portion and a socket portion, said base portion being screwed into said socket and a base of said light bulb being screwed into said socket portion;

a connecting terminal which extends outside said base portion and inside said socket portion;

a first terminal which is brought into contact with said central terminal of said socket when said base portion has been screwed into said socket;

a second terminal which is brought into contact with said central terminal of said light bulb when said base of said light bulb has been screwed into said socket portion; and a negative temperature coefficient thermistor having first and second electrodes electrically connected to said first terminal and said second terminal, respectively;

said first terminal, said second terminal and said negative temperature coefficient termistor being provided in said base portion, said thermistor being housed in a space in said base portion of said case, one end of said second terminal being located in said space and being elastically biased into contact with said second electrode whereby when said light bulb is attached to said socket through said junction socket, said peripheral terminal of said light bulb and said peripheral terminal of said socket are connected to said connecting terminal with said central terminal of said socket being connected to said central terminal of said light bulb through said first terminal, said negative temperature coefficient thermistor and said second terminal.

2. A light bulb protection arrangement as claimed in claim 1, further including:

a fuse member for protecting said negative temperature coefficient thermistor against overcurrents, said fuse member being connected between said first terminal and said negative temperature coefficient thermistor.

3. A light bulb protection arrangement as claimed in claim 2, wherein said first terminal and said fuse member are separate elements, said fuse member being for protecting said negative temperature coefficient thermistor against overcurrents.

4. A light bulb protection arrangement as claimed in claim 2, wherein said casing is of two-piece construction and comprises a first casing member and a second casing member.

5. A light bulb protection arrangement as claimed in claim 1, wherein said casing is of one-piece construction.

6. A light bulb protection arrangement as claimed in claim 4, wherein said negative temperature coefficient thermistor is formed in the shape of a rectangle.

7. A light bulb protection arrangement as claimed in claim 4, wherein said negative temperature coefficient thermistor is formed in the shape of a circle.

8. A light bulb protection arrangement as claimed in claim 6, wherein said connecting terminal comprises straight portions which are brought into contact with said peripheral terminal of said light bulbs and said peripheral terminal of said socket, respectively.

9. A light bulb protection arrangement as claimed in claim 6, wherein said connecting terminal comprises first and second portions having corrugated profiles, said first and second portions being brought into contact with said peripheral terminal of said light bulb and said peripheral terminal of said socket, respectively, said corrugated profiles of said first and second portions having a pitch which corresponds to the pitch of threads of said light bulb and said socket, respectively.

10. A light protection arrangement as claimed in claim 6, wherein said connecting terminal comprises first and second portions formed with projections, said first and second portions being brought into contact with said peripheral terminal of said light bulb and said socket, respectively, said projections of said first and second portions having a pitch which corresponds to the pitch of threads of said light bulb and said socket, respectively.

11. A light bulb protection arrangement as claimed in claim 4, wherein said first casing member is secured to said second casing member by the use of a self-tapping machine screw.

12. A light bulb protection arrangement as claimed in claim 4, wherein said first casing member is secured to said second casing member by the use of a machine screw and a nut.

13. A light bulb protection arrangement as claimed in claim 1, wherein said connecting terminal is of two-piece construction and comprises a first terminal member extending inside said socket portion and a second terminal member extending outside said base portion with said first terminal member being in contact with said second terminal member, said first terminal member comprising a straight portion which is brought into contact with said peripheral terminal of said light bulb, said second terminal member being formed into a cylindrical shape and having an internal thread formed on the inner circumference thereof and an external thread formed on the outer circumference thereof so as to be screwed into said socket, with said socket portion being screwed into said second terminal member.

14. A light bulb protection arrangement as claimed in claim 1, wherein said connecting terminal is of two-piece construction and comprises a first terminal member extending inside said socket portion and a second terminal member extending outside said base portion with said first terminal member being in contact with said second terminal member, said first terminal member comprising a cylindrical portion having an internal thread formed on the inner circumference thereof so that said base of said light bulb may be screwed into said cylindrical portion, said second terminal member being formed into a cylindrical shape and having an internal thread formed on the inner circumference thereof and an external thread formed on the outer circumference thereof so as to be screwed into said socket, with said socket portion being screwed into said second terminal member.

15. A light bulb protection arrangement as claimed in claim 1, wherein said first end of said first terminal is elastically biased into said space.

* * * * *